United States Patent [19]

Motegi et al.

[11] Patent Number: 4,716,276

[45] Date of Patent: Dec. 29, 1987

[54] ELECTRIC STEAM IRON HAVING A DETACHABLE HANDLE

[75] Inventors: Akio Motegi; Takao Saito, both of Saitama, Japan

[73] Assignee: Sanyei Corp., Japan

[21] Appl. No.: 882,214

[22] Filed: Jul. 3, 1986

Related U.S. Application Data

[63] Continuation of Ser. No. 637,771, Aug. 3, 1984, abandoned.

[30] Foreign Application Priority Data

Sep. 5, 1983 [JP] Japan ..... 58-137683

[51] Int. Cl.[4] ..... H05B 1/02; F22B 1/28; D06F 75/14; D06F 75/34

[52] U.S. Cl. ..... 219/253; 38/77.3; 38/77.82; 38/82; 38/92; 219/254; 219/255; 219/275; 219/505; 219/530; 219/540; 219/541

[58] Field of Search ..... 219/245, 251–255, 219/504, 505, 302, 275, 530, 540, 544, 541; 38/77.5, 77.8, 77.83, 77.3, 77.9, 69, 92, 71, 82

[56] References Cited

U.S. PATENT DOCUMENTS

| | | | |
|---|---|---|---|
| 686,080 | 11/1901 | Joyce | 38/92 |
| 1,969,583 | 8/1934 | Skolnik | 38/77.83 |
| 2,542,858 | 2/1951 | Boring | 38/77.83 |
| 2,620,576 | 12/1952 | Stevenson et al. | 38/77.3 |
| 2,637,126 | 5/1953 | Fitzsimmons | 38/77.9 X |
| 2,652,645 | 9/1953 | Youhouse | 38/77.8 |
| 2,802,289 | 8/1957 | Hoecker | 38/77.5 |
| 3,061,958 | 11/1962 | Gregory | 38/77.5 |
| 3,245,160 | 4/1966 | Knapp | 38/77.83 |
| 4,151,401 | 4/1979 | Van Bokestal et al. | 219/505 X |
| 4,177,375 | 12/1979 | Meixmer | 219/504 X |

FOREIGN PATENT DOCUMENTS

| | | | |
|---|---|---|---|
| 1079694 | 5/1954 | France | 219/77.83 |
| 57-142096 | 9/1982 | Japan . | |
| 57-143097 | 9/1982 | Japan . | |
| 57-143098 | 9/1982 | Japan . | |
| 57-143099 | 9/1982 | Japan . | |
| 57-145397 | 9/1982 | Japan . | |
| 57-145398 | 9/1982 | Japan . | |

*Primary Examiner*—Anthony Bartis

*Attorney, Agent, or Firm*—Ostrolenk, Faber, Gerb & Soffen

[57] ABSTRACT

An electric steam iron housing has a sole plate with a generally flat upper surface having affixed thereto a one-piece heating assembly having a front portion and a rear portion. The front portion contains a serpentine steam generating passage with an inlet communicating with a water supply container on the housing and steam outlet leading to steam vent openings extending through the sole plate. The rear portion includes top and sidewalls defining a downwardly open chamber in which is disposed a multilayer PTC electric heating element assembly in surface-to-surface contact with the upper surface of the sole plate for heating the sole plate and the steam generating passage. An adjustable thermostat responsive to the temperature of the sole plate is connected in series with the heating element. The handle of the iron is detachable and designed to serve as a storage case for the iron and the iron can be placed in the case only when the thermostat adjustment knob is in the "Off" position.

13 Claims, 10 Drawing Figures

FIG. 9
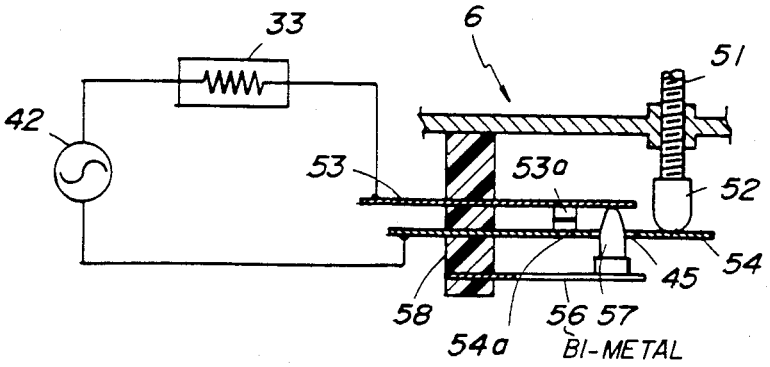
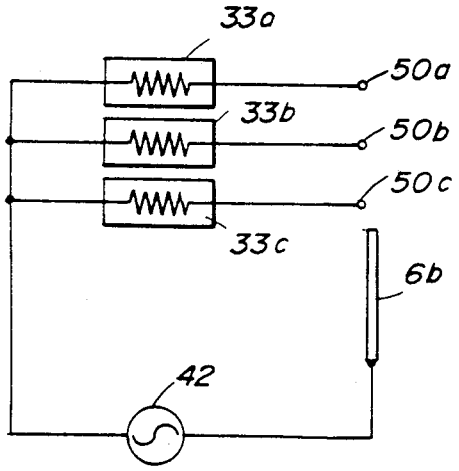
FIG. 10

ELECTRIC STEAM IRON HAVING A DETACHABLE HANDLE

CROSS REFERENCE TO RELATED APPLICATION

This is a continuation of application Ser. No. 637,771, filed Aug. 3, 1984, now abandoned.

BACKGROUND OF THE INVENTION

Field Of The Invention

This invention relates to steam irons, and more particularly, to the steam generating and ironing surface heating means of a steam iron of the compact, portable, snap-together type.

Portable irons are in use, where the separate handle locks on to the base during use, and where the handle wraps around the base to provide a flat, compact assembly for storage.

To provide a more compact iron body, a thin heating element, such as a semiconductor having a positive resistance temperature coefficient or a positive temperature coefficient thermistor, has been used. While these heating elements in theory can generate heat in the ironing temperature range, such as between 200° C. and 240° C., they have not worked satisfactorily in practice. These heating elements have only been able to provide heat to the bottom plate or ironing surface in the temperature range of between 140° C. and 170° C. This poor performance has been due to the dissipation of the heat to other adjacent surfaces and to poor heating element contact with the bottom plate resulting in uneven and insufficient heating of this ironing surface.

The above-mentioned problem was not solved by merely increasing the heat generating capacity of the heating element. Increasing this heat generating capacity has sometimes caused the iron to become overly hot, with the danger of possibly burning other parts of the iron.

SUMMARY OF THE INVENTION

The housing of the iron was redesigned to contain water. This redesign have the original purpose of redistributing the generated heat via the water, to bring the bottom plate of the iron up to the ironing temperature of approximately 200° C. However, this redesign also generated steam, which as is commonly known is a desirable commodity for eliminating wrinkles, i.e., it assists the ironing process.

The invention features a steam generating iron having a compact heating source. In order to maximize steam generation, a serpentine-like fluid passage is provided within the hollow housing of the iron adjacent the heating element. This serpintine-like passage provides for a greater volume water heating area that efficiently absorbs heat from the heating element and quickly conveys the heat to the water for generating steam. The bottom ironing surface has a steam vent for the generated steam. A source of water is carried by the housing and is in fluid communication with the passage.

A heating element is disposed within the housing and is operatively adjacent the serpentine-like passage for heating water in the housing for generating steam. The serpentine-like passage provides an extended heating surface whereby the heating element can efficiently generate enough steam to heat the sole plate to provide a sufficient ironing temperature.

It is an object of the present invention to provide an improved portable iron.

Yet another object of the invention is to adequately heat the ironing surface or sole plate of the iron.

A further object of the invention is to generate steam for ironing.

It is another object of the invention to provide a portable steam iron having a compact heating element and an extended water heating area.

A further object of the invention is to use a flat, thin heating element for the iron.

The foregoing and other objects and features of the invention will be apparent from the following description when considered in conjunction with the accompanying drawings.

BRIEF DESCRIPTION OF THE DRAWINGS

FIG. 1 is an exploded perspective view of a steam iron according to this invention;

FIG. 9 is a schematic diagram showing circuitry in the iron; and

FIG. 10 schematically shows the circuit in an alternate embodiment.

DESCRIPTION OF THE PREFERRED EMBODIMENTS

Figure 7:
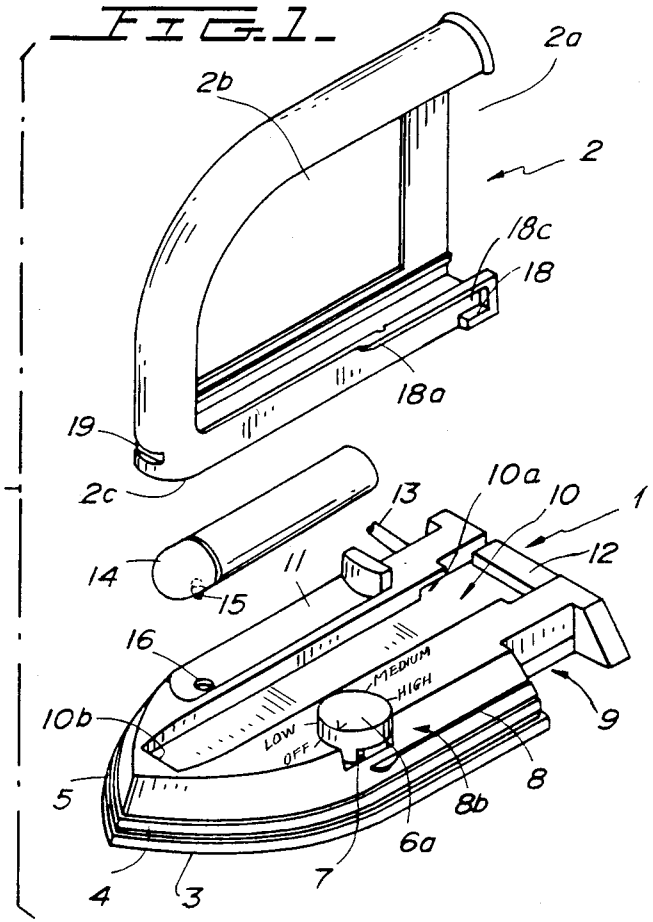
FIG. 7 is a side cross-sectional view of the bottom of the iron.
Figure 8:
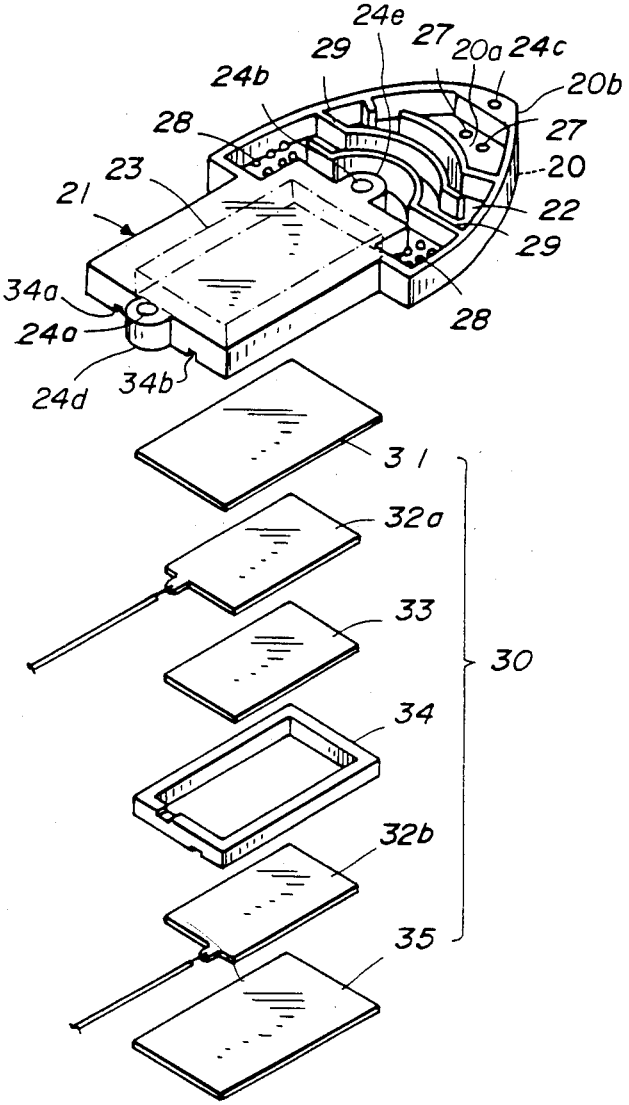
FIG. 8 is an exloded perspective view of a heat generating element and fluid passage which is used in the iron.

Referring to FIG. 1, the steam iron of this invention has a body 1 and a separable and attachable handle 2. The main iron body 1 is hollow forming a hollow housing as hereinafter described. Main body 1 comprises the sole plate 3, the base peripheral cover 4, and the top cover 5. Referring to FIGS. 7 and 8, the main body 1 houses a heat generating means 30 which is mounted on the sole plate 3. Steam vent openings 39 and 27 are provided in the sole plate 3 at the front tip 60 and in the below described steam passage 22, respectively. the base peripheral cover 4 extends around the sole plate 3 and the top cover 5, which is thermally non-conductive and therefore a heat insulator, resides above the peripheral cover 4. The peripheral cover 4 and the top cover 5 can be unitary elements or two parts fastened together by suitable means well known in the art.

As shown in FIGS. 7 and 8, there is a steam generating unit 20 which includes a serpentine steam passage 22 mounted on the upper side of the sole plate 3 at the front end thereof. The steam generating unit 20 is a separate member mounted on sole plate 3. The bottom wall **20*a* of unit 20 is formed with steam vent openings coinciding with the steam vent openings 39 in sole plate 3. It has a cover 36 closing the top of passage 22 and is integrated with a heater housing 21. The passage 22 is defined by upstanding partitions 29 to make it an elongate pathway. Together, the steam generatng unit 20 and the heater housing 21 comprise a heating assembly 61**.

The sole plate 3 of the iron has steam vent openings 39 which concide with the internal openings 27 through the bottom wall 20*a* of the unit 20. In addition, the entrance side of the steam passage 22, which is at the rear of the unit 20 between the partitions 29 and which receives dripping water, is positioned along the front side of the below described heat generating means 30, whereby that entrance side of the passageway 22 can be easily heated. The surface area of the passageway 22, to which water is exposed for heating it, is made larger by providing a large number of small protrusions 28 on the bottom wall 20*a* of the unit 20.

Figure 6:
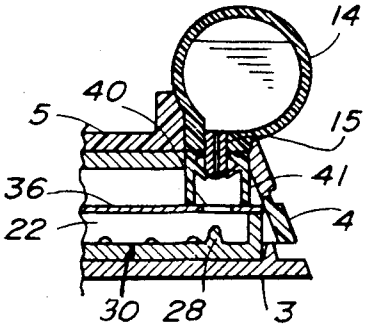
FIG. 6 is a fragmentary cross-sectional view taken along line 6—6 of FIG. 2.
Figure 7:
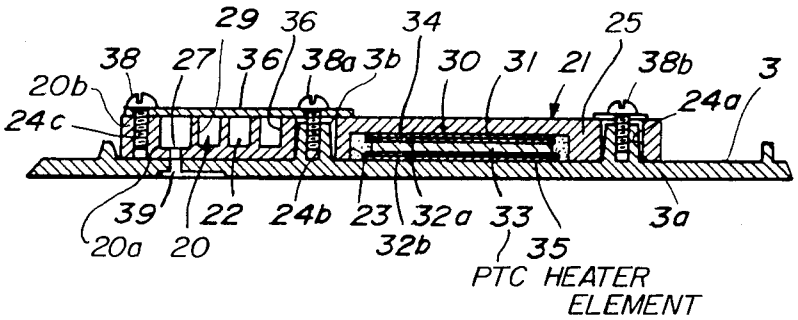
Figure 4:
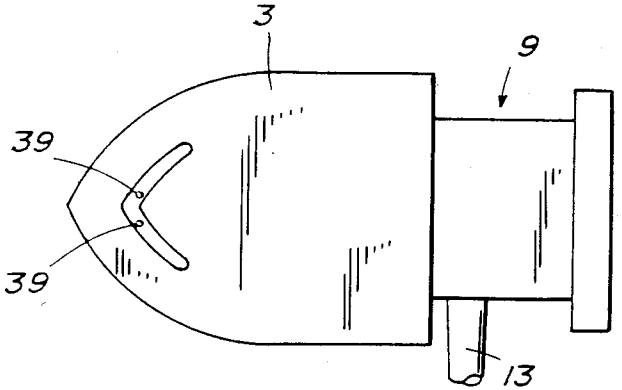
FIG. 4 is a bottom view of the iron.

As shown in FIG. 6, there is a cover 36 over the open top of the steam passage 22, which cover has a water supply opening 40. The cover 36 prevents leakage of the steam.

The heat generating means 30 is enclosed within a heater housing 21 which is integrated with the unit 20. The lower surface of the heater housing 21 contacts the upper side of the sole plate 3 of the iron, whereby the latter is heated by that contact. Specifically, the heat generating means 30 for the steam generating unit 20 is disposed in the heater housing 21 in a chamber 23 formed therein and which is being downwardly open, adjacent the rear of the steam generating unit 20. The heat generating means 30 in the chamber 23 includes an heater plate 33 that is, for example, either in the form of a plate of a semiconductor material having a positive temperature coefficient (PTC) of resistance or in the form of a positive temperature coefficient (PTC) thermistor. A pair of electrode plates 32*a* and 32*b* respectively contact the opposite top and bottom surfaces of the heater plate 33. Respective heat conductive plates 31 and 35 contact the outer sides of the electrode plates 32*a* and 32*b*. The plate 33 and elelectrode plates 32*a* and 32*b* are disposed in a supporting electrically insulating frame 34, which includes notches 34*a* and 34*b* for the projecting terminals on the plates 32*a* and 32*b*.

The thickness of the heat generating means 30 including the thermally conductive and electrical insulating plates 31 and 34 is the same as the depth of the chamber 23. This is accomplished by positioning the plates 31, 33, and 35, the electrodes 32*a* and 32*b*, and the insulating frame 34 as close together as possible.

There is a peripheral gap between the peripheral portion of heat generating means 30 and its chamber 23 into which a heat resistant electrically-insulative-fixing agent 25, such as silicon rubber, is injected. The insulating frame 34 and the electrically-insulative-fixing agent 25 prevent short-circuiting between electrode plates 32*a* and 32*b*.

The heat generating means 30 is attached to the sole plate 3, as shown in FIG. 7, by inserting the tapered studs 3*a* and 3*b* of the sole plate 3 into the openings 24*a* and 24*b* in respective flanges 24*d* and 24*e* projecting from the ends of the heater housing 21. the studs 3*a* and 3*b* are fixed in position by screws 38*a* and 38*b*.

Figure 5:
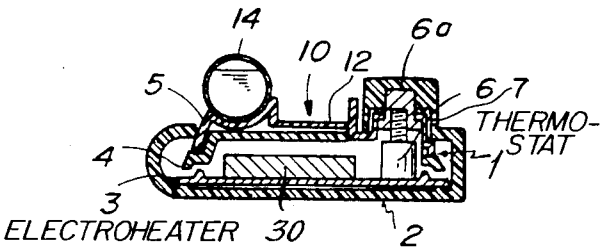
FIG. 5 is a transverse-sectional view taken along the line 5—5 of FIG. 2 with the handle removed and the body of the iron stored in the handle.

Water is supplied in drip fashion to the serpentine steam passage 22 from a detachable cylindrical water container or supply 14 which is nested in a depression 11 defined in the top of the cover 5. A feed orifice 15 from the water container 14 meters the water supply. Orifice 15 fits into the opening 16 which is provided on the upper surface of the cover 5. In the opening 16, there is a grommet or sealing collar 41, as shown in FIG. 5. The orifice 15 is made to drip water at a fixed rate into the steam passage 22 through the collar 41. The water enters the steam passage through the supply opening 40. The water is converted to steam at high thermal efficiency because the passage 22 has a long meandering route.

FIG. 9 shows heat generating means 30, represented schematically by its heater plate 33, and a thermo-switch 6 connected in series. The thermo-switch 6, has a housing 58 which supports the ends of a pair of bendable terminal plates 53 and 54 in proximity. These plates make contact via their respective opposed contacts 53*a* and 54*a*. The contact 53*a* of the housing also supports a bendable bimetallic strip 56. At the tip of the bimetallic strip 56, there is an insulating protrusion 57 which passes through a hole 45 in plate 54 to engage plate 53. The contact 53*a* of the bendable terminal plate 53 is moved out of electrical contact with the contact 54*a* of terminal plate 54 by the bimetallic strip 56 when the heat generating means 30 heats the strip 56 to a sealed operating temperature.

Figure 2:
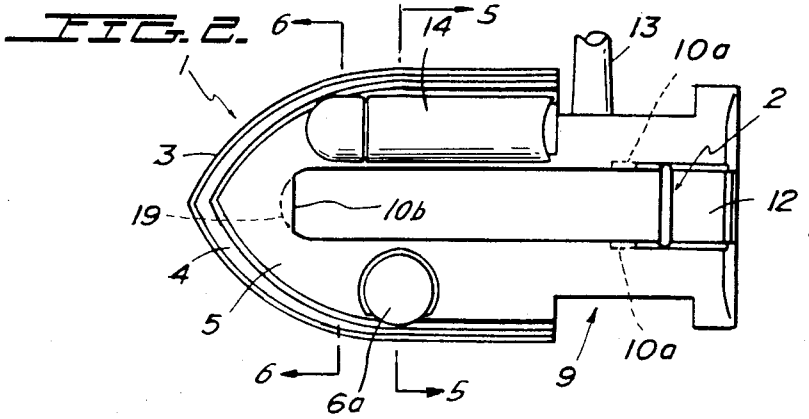
FIG. 2 is a plan view of the iron.
Figure 3:
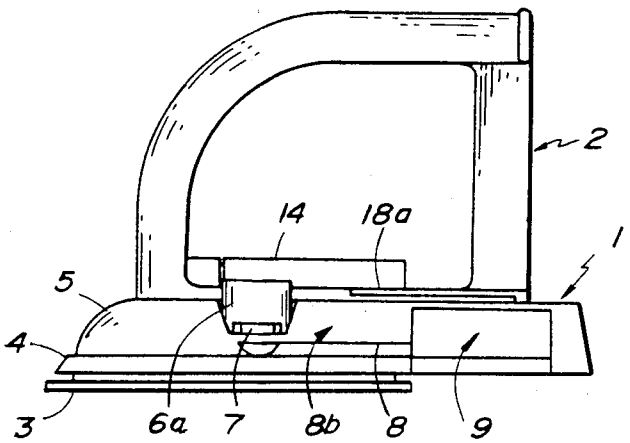
FIG. 3 is a side view of the iron.

At the end of the terminal element plate 54 is an insulating tip 52 of an adjustment screw 51 which is screw threadably advanced through the housing 58. Screw 51 is connected to the temperature adjustment knob 6*a* shown in FIGS. 1–3. The adjustment knob 6*a* is turned to a select temperature setting (as shown in FIG. 1), which causes screw 51 to force the tip 52 to bend the plate 54 to a predetermined extent, which selects the temperature at which the bimetallic strip 56 will cause the contacts 53*a*, 54*a* to move out of electric contact. The temperature adjusting knob 6*a* also serves the role of an ON and OFF switch for the electric source. At the OFF setting, the insulating tip 52 is advanced the furthest into the housing, and the terminal contacts 53*a* and 54*a* are separated. This opens the circuit containing electric source 42. The deflection of the cooled bimetal piece 56 will still not bend the terminal plate 53 enough to restore the circuit to a closed position when knob 6*a* is turned to OFF.

The temperature adjustment knob 6*a* has four rotary setting positions for selecting OFF and ON, low temperature, medium temperature, and high temperature. The rotation of the screw threaded shaft of the knob moves the insulating tip 52. When the bimetal piece 56 bends at high temperature, both contact elements 53*a* and 54*a* are made to separate in advancing degrees according to the temperature setting. When the temperature adjustment knob 6*a* has been rotated to the highest temperature position, both terminal contacts 53*a* and 54*a* are not separated by the bimetal piece 56 until that piece has been severely bent by the temperature of the iron.

In the alternative embodiment shown in FIG. 10, a plurality of heater plates 33*a*, 33*b*, and 33*c*, respectively, which generate different amounts of heat are selectively used for adjusting the heat generation, instead of using the aforementioned thermo-switch 6. These three plates are connected in parallel with the electric source 42. The side terminal elements 50*c*, 50*b*, and 50*a*, which correspond to the respective heater plates 33*c*, 33*b* and 33*a*, connect to the electric source 42 through contact means 6*b*. When the temperature adjusting knob 6*a* (not shown in FIG. 10) is rotated to the low temperature position, this moves the contact 6*b* so that electric contact is made with the heater plate 33*c* which generates a low volume of heat. When the knob is rotated to the medium temperature position, electric contact is also made by contact 6*b* with heater plate 33*b* to generate a medium volume of heat. When the knob is rotated to the high temperature position, electric contact is additionally made by contact 6b with the heater plate 33a to generate a high volume of heat. The arrangement can be adapted to enable various ones of the heater plates 33a, b, c, to be electrified.

The handle 2 also serves as a case for the main ironing body 1. It has an open side 2a for the insertion of the main ironing body 1. The open area 2b is filled by the inserted iron body 1. To assemble the iron, the bottom 2c of the handle 2 is engaged with the groove 10, which is provided on the upper surface of the top cover 5. The engagement of this handle 2 to the top cover 5 occurs through the front notch 19 at the tip of the handle 2 engaging at the tip 10b of the lip of the groove 10, and through the U-shaped ridges 18 engaging the engagement lips 10a on both sides of the rear edges of groove 10.

The rear edge of the groove 10 is open. As the handle 2 is moved either inward or outward from the main iron body 1, its bottom part 2c contacts the bottom of the groove 10. Thus, the engagement or disengagement between the handle 2 and the main ironing body 1 is accomplished.

In addition, abutment 12 limits the rearward travel of the installed handle 2. Abutment 12 is biased by a spring (not shown) to protrude above the groove 10 and, at the time when it is desired to detach handle 2 from body 1, abutment 12 is pushed down against its spring by the operator's finger to ease handle removal.

At the time when the iron is not in use and the handle is separate from the iron, the front tip of the iron body 1 is inserted into the handle 2. Surface 8 on the side of the iron body is a guide for this insertion, and ridge 18 on handle 2 contains groove 18c as a stop for the engagement of the handle 2 with the main ironing body 1.

Handle 2 serves the additional purpose of locking the knob 6a in an "OFF" position when the iron is not in use. The temperature adjusting knob 6a has a part of its peripheral surface undercut as at 7. The portion above the undercut overhangs body 5 when knob 6a is set at the rotary position of "OFF". The ridge portions 18a of handle 2 fits in the undercut 7 of knob 6a when the main body 1 has been inserted. While the main body 1 is in the handle 2, the ridge portion 18a makes it impossible to rotate the knob 6a, and particularly to rotate that knob to the "ON" position. When the iron body 1 is to receive the handle 2, it becomes impossible to insert the handle unless the adjusting knob 6a is in the "OFF" position. This is a power safety feature.

A reel for cord 13 is defined by the undercut portion 9 at the back of the body of the iron.

The heat generating means 30 used in this invention is less complex than the conventional Nichrome heating wire, and it enables design of a steam iron of thin construction. Furthermore, there is little danger of the development of conventionally experienced trouble, such as wire multilation.

Since, the heat generating means 30 is accommodated in a chamber 23, heat from both the lower and the upper heater plate surfaces is utilized to heat the sole plate 3. This is accomplished by the heater 21 that helps heat water to steam in adjacent passage 22.

In an actual test, the bottom of one of the irons according to the invention was heated to a temperature in the range of between 200 and 210 degrees Centigrade. The consumed power ranged between 70 and 150 watts (70 watts at the time when steam was not used, and 150 watts at the time when steam was used) at 120 volts.

The aforementioned heater housing 21 has the serpentine steam passage 22 adjacent to it. As a result, the area of contact with the bottom surface 3 of the iron increases, so that it becomes possible to effectively consume the heat generated by the heat generating means 30. By generating steam, the iron not only utilizes almost all the available heat being generated, but also provides a better iron surface.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A portable steam iron, comprising:

a hollow housing; a sole plate at the base of the housing; a steam vent in the sole plate communicating with said hollow housing for outlet of steam from the housing;

a water inlet to the housing and a water supply on said housing in communication with the inlet to the hollow of the housing for delivery of water to the housing;

a generally serpentine passage defined in and through the hollow of the housing and placed and shaped for transmitting water from the vicinity of the inlet toward the steam vent and for transmitting steam to the steam vent;

heat generating means in the hollow of the housing for heating water in the passage for generating steam in the passage from water in the passage, said passage having elements therein for defining a heating surface for water, and also for heating the sole plate to an ironing temperature, the heat generating means being provided with means for establishing different levels of heating of the sole plate; the iron also comprising temperature control means having a selector knob in the housing and operatively connected to the heat generating means for selecting a heat setting for the heating means; and a handle detachably attachable to the housing for supporting the housing in use; the handle also having means defining a storage case for the iron emplaceable with respect to the periphery of the housing and with respect to the periphery of the sole plate; the selector knob being shaped and positioned with respect to the periphery of said housing and the sole plate to interfere with the emplacement and removal of the handle into the storage position;

the knob having a cut away portion which provides clearance for allowing the handle to be moved past the knob to the storage position; the cut away portion being located on the knob so that when the knob is rotated to the position for the heating means to be off, the cut away portion is positioned relative to the periphery of the housing and the sole plate to permit the handle to be moved past the knob through the cut away portion to the storage position.

2. The iron of claim 1, wherein the water supply comprises a container on top of the housing.

3. The iron of claim 1, wherein the passage is defined by partitions in the housing and supported upstanding in the housing above the base.

4. The iron of claim 3, further comprising a plurality of protrusions above the base and in the passage for assisting in the heating of water in the passage for generating steam.

5. A steam iron, comprising:

a housing having a sole plate which functions as a base and as a heat transfer mechansim, the sole plate having generally flat upper and lower surfaces an a steam vent therethrough;

a water container carried by said housing;

a one-piece heating assembly for heating water and generating steam affixed to the sole plate, the heating assembly having an inlet for water connected to the water container and a steam outlet in flud communication with the steam vent in the sole plate, the heating assembly being positioned inside the housing and being mounted on the upper surface of the sole plate, and having a front portion and a rear portion, the front portion containing steam generating means for heating water and generating steam, the steam generating means having a serpentine steam generating passage means communicating at one end with said water inlet and at its other end with said steam outlet, said passage transmitting water from said inlet towards said outlet for discharge through said outlet as steam, said rear portion of said assembly having top and side walls defining a downwardly open chamber; and electric heat generating means for heating the heating assembly, the heat generating means being received in the downwardly chamber of the rear portion and being adjacent to and in surface-to-surface contact with the upper surface of the sole plate.

6. The iron of claim 5, wherein the heat generating means comprises a semiconductor having a positive temperature resistance coefficient.

7. A steam iron as set forth in claim 5, wherein the passage means is defined by upstanding partitions.

8. A steam iron as set forth in claim 7, wherein the passage means contains protrusion means for assisting in heating the water in the passage means by increasing the surface area of the passage.

9. A steam iron as set forth in claim 7, wherein the heating assembly has a flat bottom which is affixed to the upper surface of the sole plate.

10. A steam iron as set forth in claim 5, wherein the heat generating means includes a positive temperature coefficient electric resistance heating element.

11. A steam iron as set forth in claim 10, wherein the heating generating means further includes thermostatic means in series with said heating element and responsive to the temperature of said sole plate.

12. A steam iron set forth in claim 11, wherein the heating elements is a multlayered assembly comprising a flat heating element disposed between a pair of electrode plates.

13. A steam iron as set forth in claim 12, wherein the heating element includes a peripheral frame around the periphery of said multilayered assembly.

* * * * *